US005321216A

United States Patent [19]

Jamieson et al.

[11] Patent Number: 5,321,216

[45] Date of Patent: Jun. 14, 1994

[54] RESTRAINING ELEVATOR CAR MOTION WHILE THE DOORS ARE OPEN

[75] Inventors: Eric K. Jamieson, Farmington; Charles F. Fifield, Bethany, both of Conn.

[73] Assignee: Otis Elevator Company, Farmington, Conn.

[21] Appl. No.: 682,816

[22] Filed: Apr. 9, 1991

[51] Int. Cl.[5] ..... B66B 5/00

[52] U.S. Cl. ..... 187/105; 187/38; 187/104

[58] Field of Search ..... 187/90, 38, 104, 109, 187/105

[56] References Cited

U.S. PATENT DOCUMENTS

| | | | |
|---|---|---|---|
| 4,308,936 | 1/1982 | Caputo et al. | 187/104 |
| 4,538,706 | 9/1985 | Koppensteiner | 187/90 |
| 4,556,155 | 12/1985 | Koppensteiner | 187/38 |
| 4,785,914 | 11/1988 | Blain et al. | 187/105 |
| 4,923,055 | 5/1990 | Holland | 187/109 |
| 5,183,978 | 2/1993 | Sheridan et al. | 187/105 |

OTHER PUBLICATIONS

Janovsky "Elevator Mechanical Design Principles & Concepts", Ellis Horwood Limited, England (1987).

*Primary Examiner*—Steven L. Stephan
*Assistant Examiner*—Robert Nappi
*Attorney, Agent, or Firm*—Breffni X. Baggot

[57] ABSTRACT

The invention is directed to a safety circuit which detects when the car is at least a predetermined distance away from a floor landing while a car door is open. The safety circuit, upon detection of this condition, activates a solenoid located on a safety governor of the elevator car and/or the counterweight, causing safeties to engage, precluding further motion of the car and/or counterweight. The safety circuit comprises the solenoid and a relay having a contact and a coil. Given means for energizing the coil when the elevator car drifts beyond a predetermined distance with a door open, the contact will close, providing power to the solenoid for actuation. The safety circuit preferably employs a relay which indicates whether the car door is open or closed, as well as relays which indicate whether various other system operational checks are satisfactory. To check the functionality of the components upon which the safety circuit relies, the preferred embodiment provides additional circuitry to check the functionality of the door relay and the operational check relay, as well as circuitry to check the electrical integrity of and the power connections to the solenoid. The safety circuit actuates the solenoid if a car door is open, the car is beyond the predetermined distance from the landing, and a machine tachometer indicates a non-zero velocity. The predetermined distance from the landing is preferably the outer door zone.

8 Claims, 6 Drawing Sheets

RESTRAINING ELEVATOR CAR MOTION WHILE THE DOORS ARE OPEN

BACKGROUND OF THE INVENTION

1. Technical Field

The present invention is directed to an elevator car safety device. More particularly, the present invention is directed to an elevator car safety device which activates when the elevator car moves away from a landing with its door open.

2. Background Information

A typical traction elevator system includes an elevator car connected to a counterweight by a steel cable which passes over a sheave. The sheave, generally located in a machine room at the top of an elevator shaft, is connected to a hoist machine which controls the vertical motion of the elevator car in the elevator shaft.

The hoist machine principally comprises a drive motor and a brake. The drive motor, connected to the sheave in either geared or gearless fashion, controls the rotation of the sheave and thus the travel of the elevator car. The brake, either drum or disk, is directly connected to the sheave and is used to hold the elevator car stationary.

A traction elevator system also includes a safety governor which senses the speed of the elevator car. The safety governor includes a governor rope passing around a safety governor pulley, located in the machine room, down to a tensioning pulley, located at the bottom of the elevator shaft, and back again to the governor pulley. The governor rope is typically connected to a progressive safety mounted on the elevator car. The safety governor detects an overspeed condition of the elevator car based on the fact that the rotational velocity of the governor pulley is proportional to the speed of the elevator car.

Various safety governors are known in the art. For example, in U.S. Pat. No. 4,556,155 issued to Koppensteiner and herein incorporated by reference, a safety governor having two diametrically opposed flyweights located on the governor pulley is shown. As the elevator car travels up and down the elevator shaft, the flyweights move outwardly due to the centrifugal force imparted thereon by the rotating governor pulley.

In an overspeed condition, defined herein as when the speed of the elevator car exceeds a rated speed by a predetermined value, the flyweights are driven outwards and trip an overspeed switch which cuts off power to the drive motor and sets the brake.

If the elevator car speed continues to increase, the further outward motion of the flyweights causes them to trip a mechanical latching device, releasing a swinging jaw which is normally held clear of the governor rope. When the swinging jaw is released, it clamps the governor rope against a fixed jaw, thereby retarding governor rope motion. The retarding action exerted on the governor rope causes safeties located on the elevator car to engage, thereby progressively decelerating and ultimately arresting the motion of the elevator car.

Various safeties are known in the art. For example, in U.S. Pat. No. 4,538,706 issued to Koppensteiner and herein incorporated by reference, a safety having a roller located between the elevator car guide rail and a leaf spring is shown. The leaf spring and guide rail form a triangular section with the roller located at the base of the triangular section during normal operation.

The force exerted on the governor rope causes a safety gear linkage to lift the roller into the tapered portion of the triangular section. The leaf spring exerts pressure on the guide rail via the roller, and the pressure is progressively increased as the roller moves into the tapered portion of the triangular section. The exerted pressure gradually decelerates and ultimately arrests the motion of the elevator car.

During normal elevator system operation, an elevator car is dispatched to a floor, e.g., in response to a hall call and/or a car call. In order to increase the efficiency of the elevator system, it is desirable to have the elevator car door begin opening prior to the car coming to a complete stop at the floor landing. Safety codes permit the elevator car door to begin opening prior to the elevator car coming to a complete stop, provided the elevator car is within a predefined area, commonly referred to as an outer door zone, and is traveling below a predefined speed. The outer door zone is typically 24 inches (600 mm) centered about the floor landing.

The arriving elevator car decelerates and, once within the outer door zone, begins to open the car door. The elevator car will hover at the landing until it is level therewith. Once the elevator car is properly positioned at the landing, the brake is set and the drive motor is shut down. Should the elevator car drift from the landing, the drive motor is re-energized to re-level the elevator car.

Under normal conditions, an engaged drive and a set brake are each capable of holding the elevator car at the landing and/or stationary. However, should either the drive or the brake malfunction, the elevator car can drift away from the landing.

Elevator safety codes are being enacted which require a drifting elevator car to be stopped should the car drift more than a predefined distance with its door open. Specifically, if an elevator car drifts more than 500 mm (about 20 inches) from a landing with its door open, the car must be brought to a complete stop within another 750 mm (about 30 inches).

SUMMARY OF THE INVENTION

Accordingly, it is an object of the present invention to provide a safety device which will preclude further elevator car motion should the car drift beyond a predetermined distance with its door open.

It is a further object of the present invention to check the functionality of the components of the circuit and suspend elevator car operation in the event any of the components are not deemed satisfactory.

In accordance with these and other objects, the present invention is directed to a safety circuit which detects when the elevator car is at least a predetermined distance away from a floor landing while a door of the elevator car is open. The safety circuit, upon detection of this condition, activates a solenoid, located on a safety governor of the elevator car and/or counterweight, causing safeties to engage which precludes further motion of the car and/or counterweight.

The safety circuit of the present invention, in its most basic form, requires only the solenoid and a relay having a contact and a coil. Given a means for energizing the coil when the elevator car drifts beyond a predetermined distance with its door open, the contact will close, providing a path for power through the solenoid and thereby actuating the solenoid.

The activated solenoid trips a mechanical latching device, releasing a swinging jaw which is normally held clear of the governor rope. When the swinging jaw is released, it clamps the governor rope against a fixed jaw, thereby retarding further governor rope motion.

For the elevator car governor, the retarding force causes a safety located on the elevator car to engage, thereby progressively decelerating and arresting the motion of the elevator car. For the counterweight governor, the retarding force causes a safety located on the counterweight to engage, thereby progressively decelerating and arresting the motion of the counterweight.

The safety circuit preferably employs a relay which indicates whether the door is open or closed, as well as relays which indicate whether various other system operational checks are satisfactory.

In order to check the functionality of the components upon which the safety circuit relies, the preferred embodiment of the present invention provides the additional circuitry to check the functionality of the door relay and the operational check relay, as well as circuitry to check the electrical integrity of and the power connections to the solenoid.

The safety circuit actuates the solenoid if a door to the elevator car is open, the elevator car is beyond the predetermined distance from the landing, and a tachometer (connected to the drive motor) indicates a non-zero velocity. In the preferred embodiment, the predetermined distance from the landing is preferably the outer door zone.

The tachometer reading is preferably employed as a condition for actuating the solenoid to account for those situations where a door might be open outside the outer door zone but where the brake is operating properly. For example, the door might be open outside of the outer door zone to rescue a passenger stuck between floors. Provided the brake is operating properly, the tachometer will indicate a zero velocity and the safety circuit will not actuate the solenoid.

DESCRIPTION OF THE PREFERRED EMBODIMENT(S)

Figure 1:
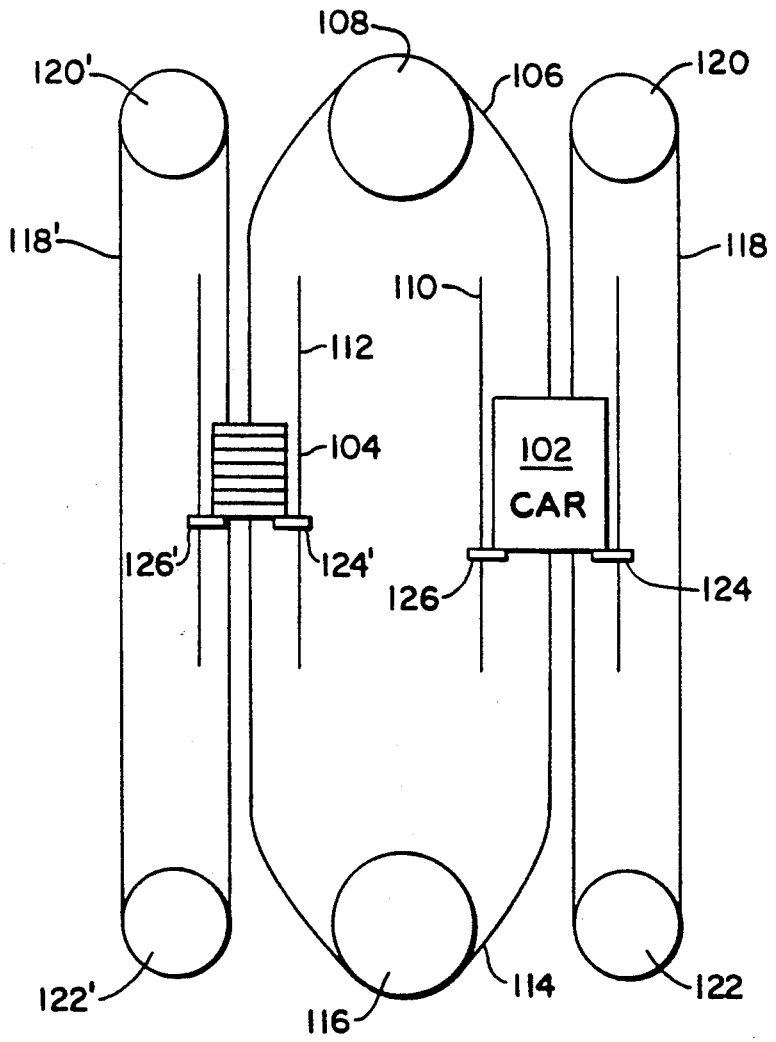
FIG. 1 PRIOR ART
FIG. 1 depicts an overview of a traction elevator system in which the safety circuit of the present invention finds particular utility.

Turning now to FIG. 1, an overview of a traction elevator system is illustrated. The system includes elevator car 102 connected to counterweight 104 by cable 106 which passes over sheave 108.

The rotation of sheave 108 is controlled by a hoist machine (not shown) which includes a drive motor and a brake. The vertical travel of the elevator car and counterweight are guided by rails 110 and 112, respectively, securely attached in the elevator shaft. Compensation cable 114 is preferably attached between the elevator car and the counterweight via tensioning pulley 116.

The traction elevator system is preferably provided with a governor which senses the speed of the elevator car. The governor includes governor rope 118 passing around governor pulley 120 and tensioning pulley 122 and is securely attached to the car at safeties 124 and 126. The rotational velocity of the governor pulley is proportional to the speed of the elevator car.

In the preferred embodiment, the traction elevator system further includes a governor located on the counterweight. The counterweight governor is preferably substantially similar to the elevator car governor, and is indicated by references 118' to 126'. For the sake of brevity, however, only the elevator car governor will be discussed.

Figure 2:
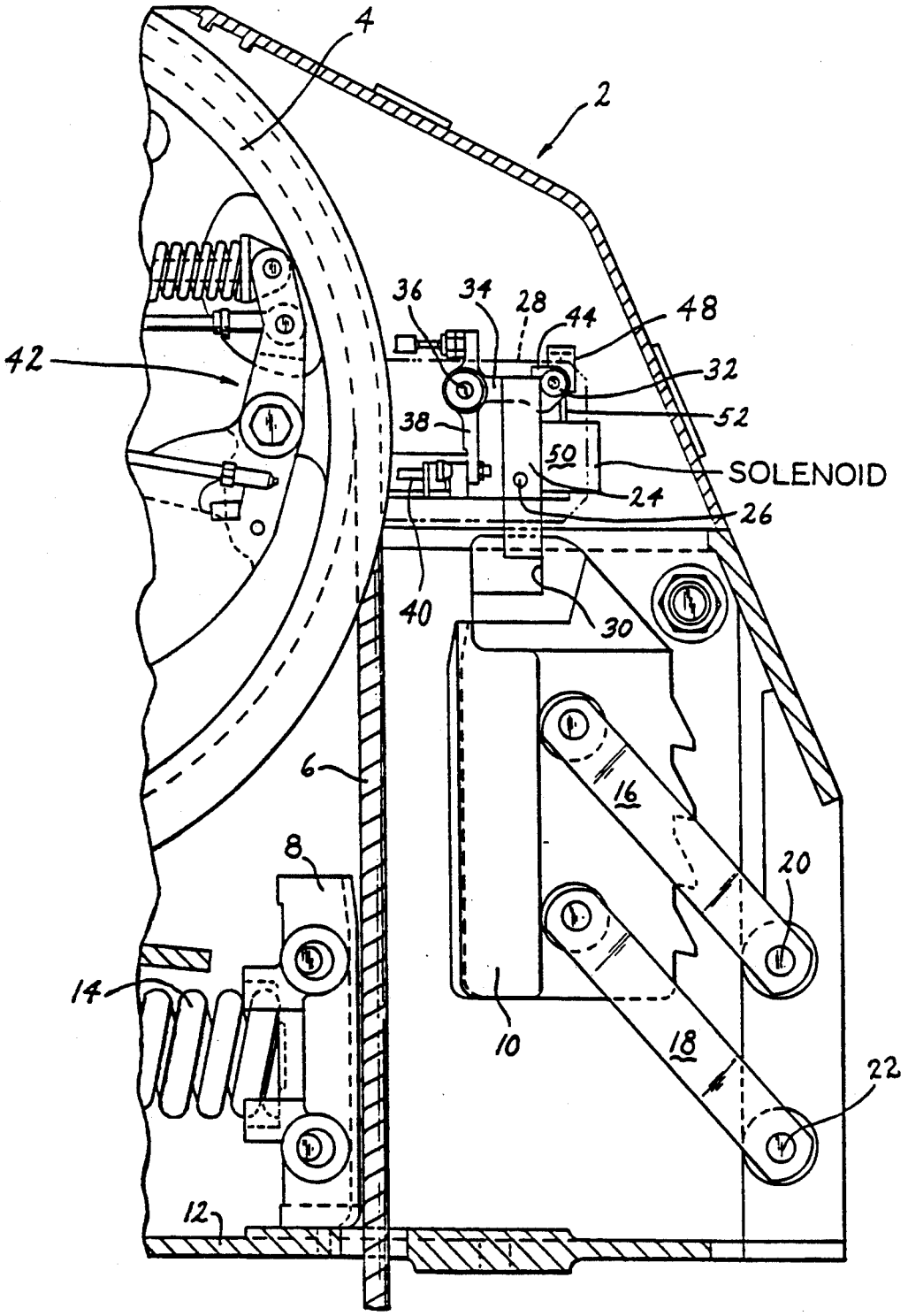
FIG. 2 is a fragmented cut-away side view of the governor sheave housing and assembly preferably employed with the present invention.
Figure 3:
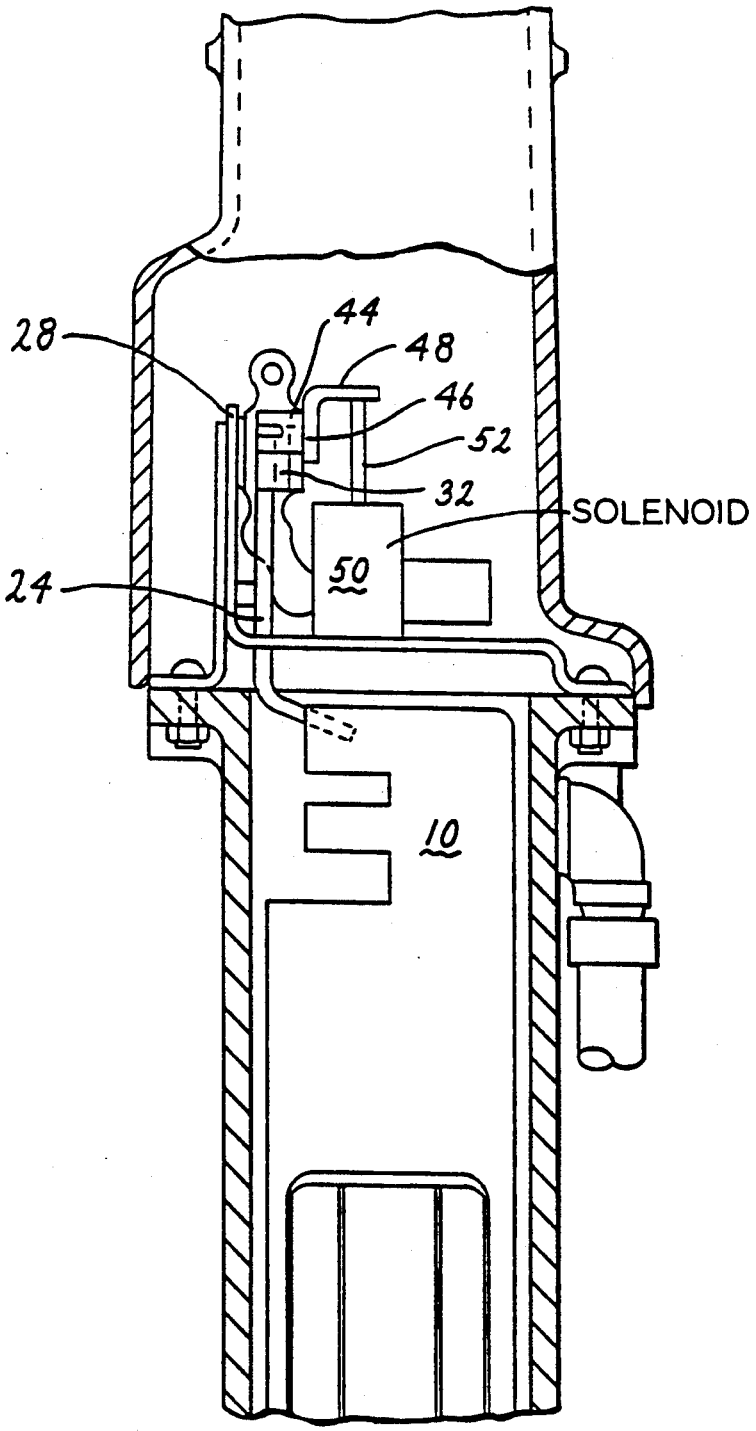
FIG. 3 is a detailed front view of a portion of the assembly shown in FIG. 2.

The governor, described in more detail with reference to FIGS. 2 and 3, is activated either when the elevator car enters an overspeed condition, defined herein as when the speed of the elevator car exceeds a rated speed by a predetermined value, or when the elevator car enters a lowspeed condition, defined herein as when the elevator car drifts from a landing more than a predefined distance with its door open. In the preferred embodiment, the predefined distance is less than or equal to the distance set forth in the relevant elevator safety code requirements, e.g., 500 mm (about 20 inches). More preferably, however, the predefined distance is equal to the outer door zone, e.g., 300 mm (about 12 inches).

In an overspeed condition, conventional flyweights located on the governor pulley are driven outwards and trip a conventional overspeed switch which cuts off power to the drive motor and sets the brake. If the elevator car speed continues to increase, further outward motion of the flyweights causes a conventional mechanical latching device to be tripped, releasing a swinging jaw which is normally held clear of the governor rope. The released swinging jaw clamps the governor rope between itself and a fixed jaw, thereby retarding governor rope motion. The retarding action exerted on the governor rope causes the conventional safeties located on the elevator car to engage, thereby progressively decelerating and ultimately arresting the motion of the elevator car.

In a lowspeed condition, a lowspeed safety device, described in more detail with reference to FIGS. 4 through 6, trips the mechanical latching device on the governor, causing the safeties on the elevator car to engage and ultimately arresting the motion of the elevator car.

The preferred embodiment of the governor, described below with reference to FIGS. 2 and 3, is set forth in more detail in U.S. patent application serial number xxx,xxx to Sheridan et al., entitled "Emergency Elevator Governor Actuator" filed on Apr. 3, 1991, owned by the same assignee as the present invention and herein incorporated by reference.

Turning now to FIG. 2, a portion of governor sheave housing 2 in which governor cable sheave 4 is mounted is shown. Governor cable 6 is reeved about sheave 4, passes downwardly into the hoistway, and connects with conventional safeties 124 and 126 (FIG. 1) mounted on the elevator car.

A pair of blocks 8 and 10 are disposed in housing 2 on either side of governor rope 6. Block 8 is mounted on floor 12 of housing 2 and is biased by spring 14 toward governor rope 6. Block 10 is carried on a pair of levers 16 and 18 which are pivotally mounted in housing 2 on pins 20 and 22, respectively.

As shown in FIG. 2, governor rope 6 is free to move in either direction, up or down, unimpeded by blocks 8 and 10 since block 10 is held away from the rope by latch lever 24. Latch lever 24 is pivoted about pin 26 on plate 28 (shown in phantom), with lever 24 engaging catch surface 30 on block 10. It will be appreciated that lever 24 is being urged about pin 26 in a clockwise direction by the weight of block 10, which by gravity wants to swing downwardly toward block 8 and governor rope 6.

Pivoting of lever 24 is prevented by roller 32 which engages the top of lever 24, and which is mounted on crank 34 which pivots on plate 28 about pin 36. Under normal operating conditions, crank 34 is in the position shown in FIG. 2 wherein block 10 is held away from block 8 and rope 6. Crank 34 includes downwardly extending arm 38 to which is connected mechanical actuating rod 40. The actuating rod is operably connected in a conventional manner to flyweight assembly 42 mounted on governor rope sheave 4.

During an overspeed condition, flyweight assembly 42 moves radially outwardly and pushes rod 40 to the right, as viewed in FIG. 2. This causes crank 34 to pivot in the counterclockwise direction about pin 36, which in turn lifts roller 32 away from lever 24, thereby allowing block 10 to drop into locking engagement with rope 6 and block 8, retarding further movement of rope 6. The retarding action causes the conventional safeties located on the elevator car to engage, thereby progressively decelerating and ultimately arresting the motion of the elevator car.

Turning now to FIG. 3, roller 32 is mounted with cover 44 which provides surface 46 to which bracket 48 is welded. Solenoid 50 is positioned below bracket 48 and operates actuating rod 52 which contacts bracket 48. Rod 52 is normally retracted, as shown in FIGS. 2 and 3, when the elevator is operating under normal conditions.

During a lowspeed condition, solenoid 50 is actuated, extending rod 52 against bracket 48, causing crank 34 to pivot, releasing lever 24 and allowing block 10 to drop against rope 6 and block 8, retarding further movement of rope 6, causing the safeties to engage.

The dispatching and operation of the elevator car is controlled by an elevator control system, preferably as described in DE/EP 0,239,662 to Auer et al., published Oct. 7, 1987 (corresponding to U.S. application Ser. No. 029,495, filed Mar. 23, 1987), both of which are herein incorporated by reference.

An elevator car assigned to a floor landing will begin to decelerate in order to stop at the floor. Once the car is within the outer door zone, the control system will activate a door motor to begin opening the car door, provided the car is traveling below a predetermined speed. The control system then monitors the position of the elevator car. Typically, the arriving elevator car hovers at the floor landing until it is level therewith. Once the elevator car is properly positioned at the landing, the brake is set and the drive motor is shut down.

Should the elevator car drift from the landing, the drive motor is re-energized to re-level the car. However, should the elevator car drift from the landing beyond a predefined area, the present invention precludes further motion of the elevator car, preferably by actuating solenoid 50 (FIG. 2), thereby engaging the safeties located on the elevator car.

In the preferred embodiment, the predefined distance is less than or equal to the distance specified in the relevant elevator safety code requirements, e.g., 500 mm (about 20 inches). More preferably, however, the predefined distance is equal to the outer door zone, e.g., 300 mm (about 12 inches).

Detecting the position of the elevator car, relative to the outer door zone, is well known in the art. See, for example, U.S. Pat. No. 4,674,604 issued to Williams, herein incorporated by reference. Should the elevator car drift beyond the outer door zone with its door open, a controller, e.g., the controller which directs the operation of the drive and brake and has inputs regarding the door position, and associated circuitry of the present invention preferably actuates the solenoid, causing the safeties to engage.

Figure 4:
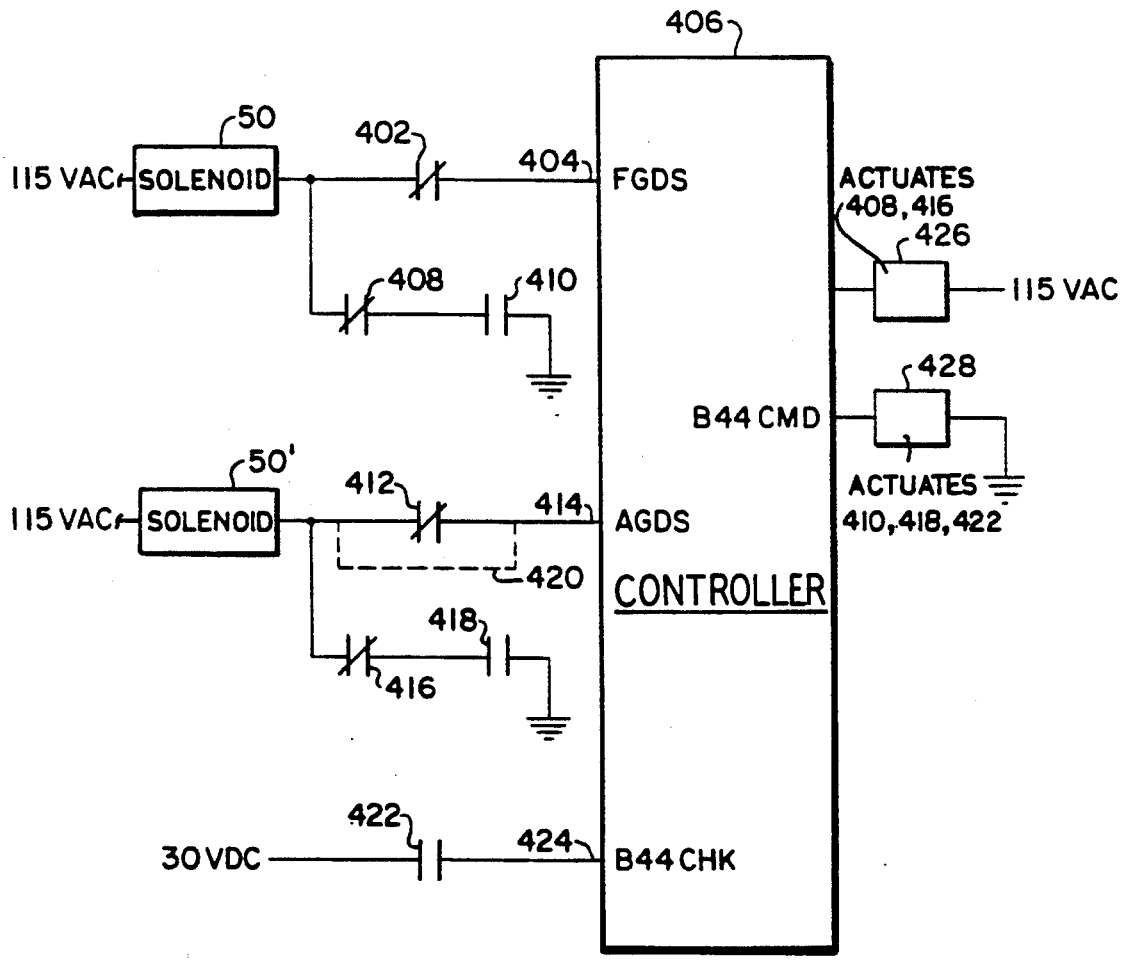
FIG. 4 is the preferred embodiment of the safety circuit of the present invention.

Turning now to FIG. 4, a preferred embodiment of the safety circuit for actuating the solenoid should an elevator car drift beyond the outer door zone is illustrated. The safety circuit preferably includes solenoid 50, located on the elevator car governor, connected via normally-closed FGDS contact 402 to input 404 of controller 406. Solenoid 50 is connected to a ground potential via normally-closed EES contact 408 and normally-open B44 contact 410.

As known in the art, an FGDS coil (not shown) is energized when the front door of the elevator car is closed. Thus, FGDS contact 402 is in an open state when the front door is closed, and is in a closed state when the front door is open. Typically, two FGDS relays are connected in parallel in the front door chain to insure proper closed-door sensing. Where two FGDS relays exist, both contacts are preferably placed in series connection between solenoid 50 and input 404 of the controller.

The safety circuit preferably also includes solenoid 50', located on the counterweight governor, connected via normally-closed AGDS contact 412 to input 414 of the controller. Solenoid 50' is connected to a ground potential via normally-closed EES contact 416 and normally-open B44 contact 418. The safety circuit preferably further includes normally-open B44 contact 422 connected to input 424 of the controller, EES coil 426 and B44 coil 428.

As known in the art, an AGDS coil (not shown) is energized when the rear (or auxiliary) door of the elevator car is closed. Thus, AGDS contact 412 is in an open state when the rear door is closed, and is in a closed state when the rear door is open. Typically, two AGDS relays are connected in parallel in the rear door chain to insure proper closed-door sensing. Where two AGDS relays exist, both contacts are preferably placed in series connection between solenoid 50' and input 414 of the controller. In the event the elevator car is not equipped with a rear door, jumper 420 connects solenoid 50' to input 414 of the controller.

In the preferred embodiment, the EES relay is an IEC-rated device having multiple contacts 408 and 416 controlled by single coil 426. Additionally, the B44 relay is an IEC-rated device having multiple contacts 410, 418 and 422 controlled by single coil 428. As known in the art, an IEC-rated device means if one of the multiple contacts closes, all will close. Conversely, if one of the multiple contacts is stuck and is non-functional, all will be non-functional.

The present invention, in its most basic form, requires only solenoid 50, a B44 relay having contact 410 and coil 428. Given a means for energizing the coil when the elevator car drifts beyond the outer door zone with its door open, contact 410 will close, providing a path for power and thereby actuating the solenoid.

The preferred embodiment of the present invention, however, provides the other components of FIG. 4 in order to check the functionality of the EES, B44, FGDS and AGDS relays, as well as to check the electrical integrity of and the power connections to each of the solenoids.

Figure 5:
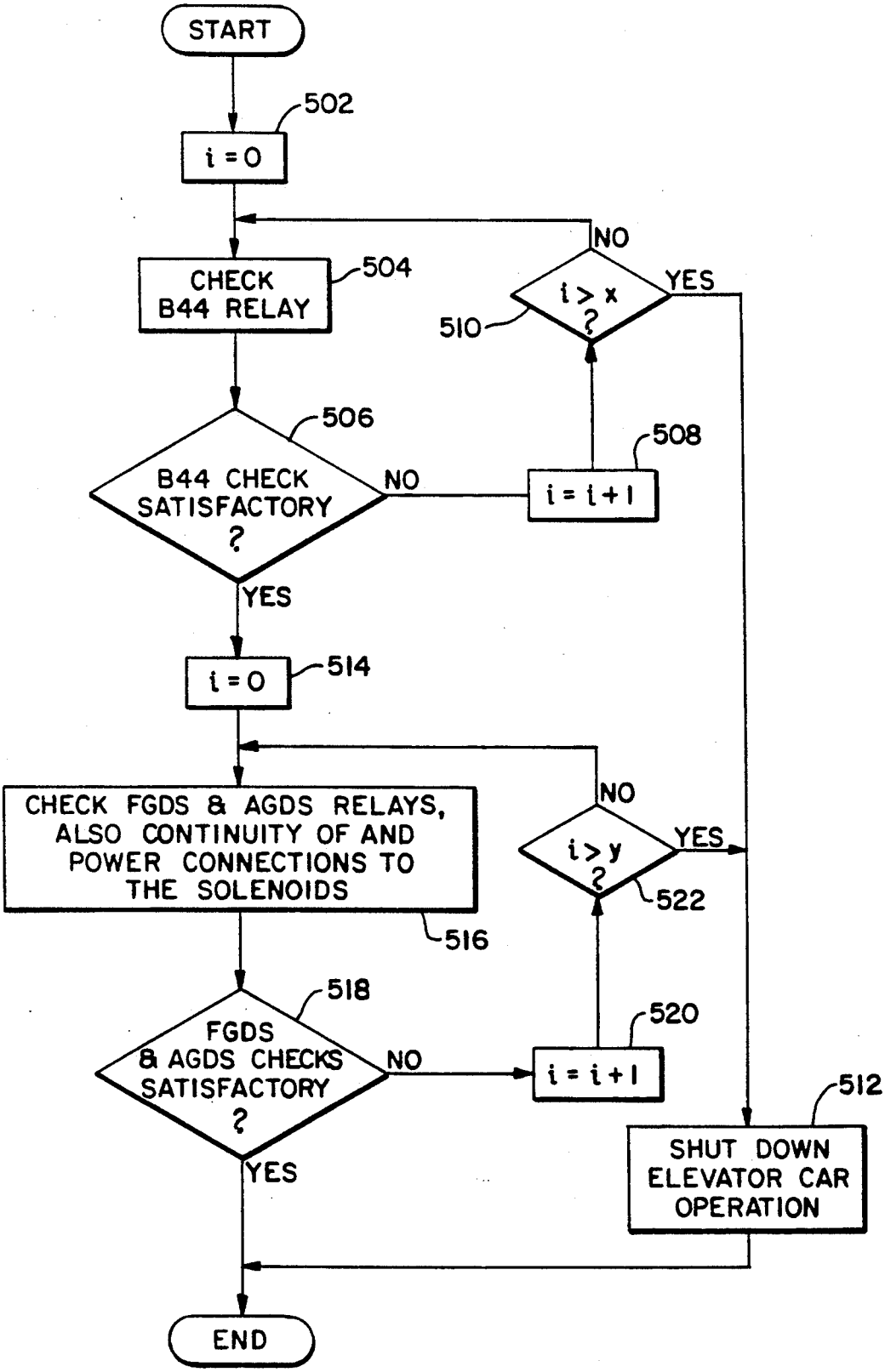
FIG. 5 illustrates a preferred method of checking the integrity and functionality of the various components of the circuit shown in FIG. 4.

Turning now to FIG. 5, a preferred method is illustrated for checking the functionality of the EES, B44, FGDS and AGDS relays and the electrical integrity of and the power connections to each of the solenoids. The method of FIG. 5 is preferably commenced when there is demand for the elevator car, e.g., prior to when the elevator car leaves a landing.

At step 502, the parameter i is initialized to zero. The B44 relay having contacts 410, 418 and 422 and coil 428 is checked at step 504 for functionality, preferably by having the controller energize B44 coil 428, closing the B44 contacts.

If, at step 506, a voltage is registered at input 424 of the controller, the relay is deemed functional. However, should no voltage be registered, step 504 is repeated x number of times, as set forth by steps 508 and 510. If a voltage is not registered after x number of retries, the elevator car is taken out of service at step 512. In the preferred embodiment, x is set equal to ten.

As known in the art, EES contacts 408 and 416 are included in the conventional safety chain. Therefore, the EES contacts remain in an open state so long as normal system operational checks prove satisfactory. Thus, an electrical path through the solenoids is not provided and the solenoids are not activated.

At step 514, the parameter i is again initialized to zero. The FDGS relay having contact(s) 402 and a coil (not shown), and the AGDS relay having contact(s) 412 and a coil (not shown), are checked at step 516 for functionality, along with the electrical continuity of the solenoids and the power connections thereto.

In the preferred embodiment, functionality of the FDGS and AGDS relays are checked during a conventional door safety chain test. See, e.g., U.S. patent application No. 520,003, filed May 7, 1990 by Coste et al., entitled "A Separate Elevator Door Chain", assigned to the same assignee as the present invention and herein incorporated by reference. During the door safety chain test, the FGDS and AGDS coils are de-energized, causing FGDS contact(s) 402 and AGDS contact(s) 412 to close.

If, at step 518, a voltage is registered at inputs 404 and 414 of the controller, the FGDS and AGDS relays, respectively, are deemed functional, the solenoids are deemed to have electrical continuity, and and power connections to the solenoids are deemed proper. In the preferred embodiment, inputs 404 and 414 are high-impedance inputs, drawing about 10 milliamperes through their respective solenoid and closed contact. This small current draw is not enough to power the solenoids.

Should no voltage be registered at either input, step 516 is repeated y number of times, as set forth by steps 520 and 522. If a voltage is not registered at both inputs after y number of retries, the elevator car is taken out of service at step 512. In the preferred embodiment, y is set equal to ten.

If the FGDS and AGDS relays, the electrical continuity of the solenoids and the power connections thereto are deemed satisfactory, the elevator car is allowed to leave the landing and continue its normal operation. Otherwise, the elevator car is taken out of service at step 512, preferably until an authorized service representative assesses and corrects the problem.

Figure 6:
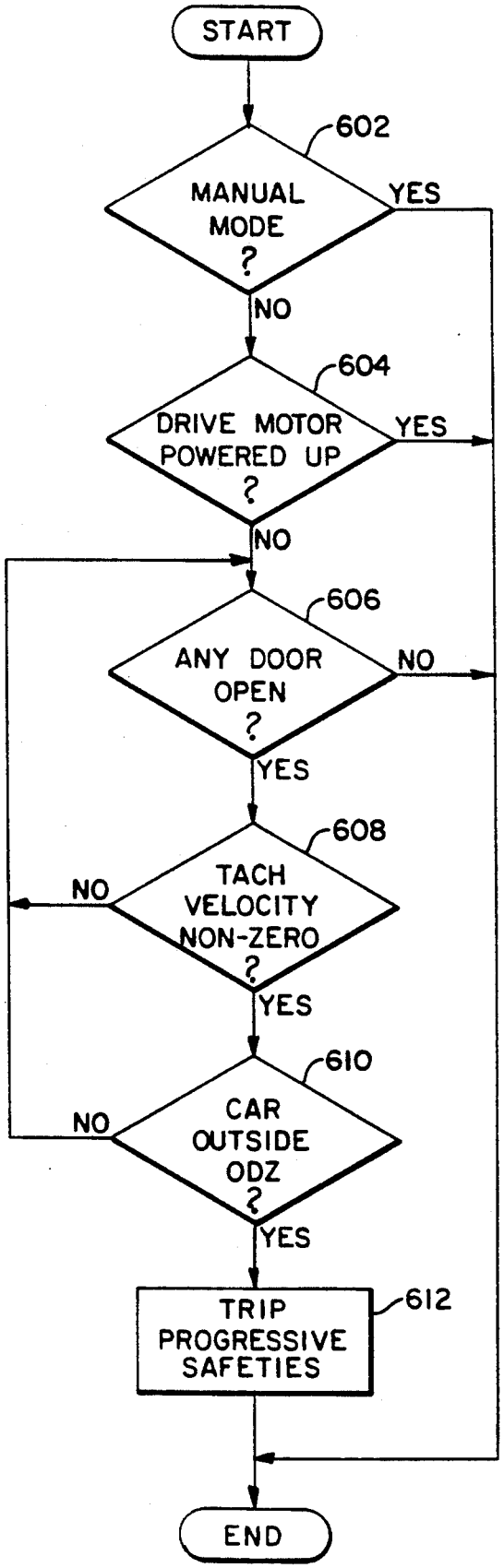
FIG. 6 illustrates a preferred method of triggering the safety devices should the elevator car travel beyond the outer door zone with its door open.

Turning now to FIG. 6, a preferred method of triggering the safeties on the elevator car should the elevator car enter a lowspeed condition, i.e., where the car drifts beyond the outer door zone with its door open, is illustrated. The method of FIG. 6 is preferably operable whenever the elevator car is operating.

Whenever the elevator car is in manual mode, step 602 bypasses the lowspeed triggering logic of steps 606 through 612. As will be appreciated by those skilled in the art, an authorized service representative often desires to move the elevator car through the shaftway with the elevator car door(s) open, and is permitted to do so provided she places the elevator car in manual mode.

Whenever the drive motor is powered up, step 604 also bypasses the lowspeed triggering logic. Since the elevator car is able to re-level itself as well as hold the elevator car at the landing whenever the drive motor is powered up, the lowspeed triggering logic is deemed unnecessary.

If the drive motor is not powered up, the brake is either set or is in the process of being set. Thus, the lowspeed triggering logic of steps 606 through 612 check the integrity of the brake and compensate therefor in the event of brake misoperation.

At step 606, if no elevator car door is open, the lowspeed triggering logic is preferably bypassed, since any brake malfunction causing an overspeed condition is compensated via conventional mechanical flyweights, located on the governor, which trip the safeties.

At steps 608 and 610, if the velocity of the tachometer is non-zero, indicative of a moving drive motor sheave and thus a moving elevator car, and the position of the elevator car is beyond the outer door zone, brake misoperation is deemed to have occurred. Thus, at step 612, the safeties are tripped. Steps 608 and 610 preferably are continuously repeated until either all of the elevator doors are closed or until the safeties are tripped.

In the preferred embodiment, the tachometer is preferably sensed for a non-zero reading to account for those situations where a door might be open while the car is outside the outer door zone but where the brake is operating properly. For example, the door might be open outside of the outer door zone to rescue a passenger stuck between floors. Provided the brake is operating properly, the tachometer will indicate a zero velocity and the safety circuit will not activate the solenoid.

Determining the position of the elevator car, relative to the outer door zone, is known in the art. For instance, the relative position is determinable based on sensors located at the outer door zone boundaries, as shown for example in U.S. Pat. No. 4,674,604 issued to Williams, herein incorporated by reference.

In the preferred embodiment, the safeties are tripped at step 612 by de-energizing EES coil 426 (FIG. 4) and energizing B44 coil 428. EES contact and B44 contact therefore both close, providing a path to ground which activates solenoids 50 and 50'. Solenoid activation drives push rod 52 (FIGS. 2 and 3) against bracket 48, causing crank 34 to pivot, thereby releasing lever 24 and allowing block 10 to drop against governor rope 6 and block 8. This action further causes safeties 124, 126, 124' and 126' to engage, arresting the motion of the elevator car and counterweight.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What we claim as our invention is:

1. A circuit for actuating a solenoid thereby precluding motion of an elevator car, comprising:

the solenoid, said solenoid having first and second electrical connection ends, the first end electrically connected to a source of power;

a first contact having first and second electrical connection ends, said first contact having a normally-open state, the first end of said first contact electrically connected to the second end of solenoid, the second end of said first contact electrically connected to a ground potential; and means for closing said first contact when the elevator car moves at least a predetermined distance from a predetermined location while the elevator car door is open, allowing current to flow through said solenoid and thereby actuating said solenoid, precluding further motion of the elevator car;

means for checking the electrical continuity of said solenoid.

2. The circuit of claim 1, said circuit further comprising:

means for checking the connection of said solenoid to the source of power and the availability of the power source without actuating said solenoid.

3. The circuit of claim 2, wherein said means for checking comprises:

a second contact having first and second electrical connection ends, the first end of said second contact electrically connected to the second end of said solenoid, the second end of said second contact electrically connected to a high-impedance input of a controller; and means for closing said second contact;

said controller determining whether a voltage is registered at the input of said controller when said second contact is closed, thereby checking the electrical continuity of said solenoid, the connection of said solenoid to the source of power and the availability of the power source without actuating said solenoid.

4. The circuit of claim 2, said circuit further comprising:

means for precluding further service of the elevator car should said checking means determine that said solenoid either does not have electrical continuity, is not connected to said source of power or that said source of power is not available.

5. A circuit for actuating a solenoid, thereby precluding motion of an elevator car, comprising:

the solenoid, said solenoid having first and second electrical connection ends, the first end electrically connected to a first source of power;

a first contact having first and second electrical connection ends, said first contact having an open state provided predetermined safety checks are satisfactory and having a closed state when predetermined safety checks are unsatisfactory such as when the elevator car moves a predetermined distance from a predetermined location when the elevator car door is open, the first end of said first contact electrically connected to the second end of said solenoid;

a second contact having first and second electrical connection ends, said second contact having a normally-open state, the first end of said second contact electrically connected to the second end of said first contact, the second end of said second contact electrically connected to a ground potential;

means for closing said second contact when the elevator car moves at least a predetermined distance from a predetermined location while the elevator car door is open, allowing current to flow through said solenoid and thereby actuating said solenoid, precluding further motion of the elevator car; and means for checking the functionality of said second contact without actuating said solenoid.

6. The circuit of claim 5, said circuit further comprising:

means for precluding further service of the elevator car should said checking means determine that said second contact is not functioning properly.

7. The circuit of claim 5, wherein said means for checking the functionality of said second contact comprises:

a third contact having first and second electrical connection ends, said third contact being International Electrical Code (IEC) rated with respect to said second contact such that the second and third contacts open or close together, the first end of said third contact electrically connected to a second source of power, the second end of said third contact electrically connected to an input of a controller;

said controller closing said third contact, causing said second contact to close and a voltage to be registered at the input of said controller provided said second contact is functioning properly, without actuating said solenoid.

8. The circuit of claim 7, said circuit further comprising:

means for precluding further service of the elevator car should said checking means determine that a voltage was not registered at the input of said controller.

* * * * *